US009340259B2

(12) United States Patent
Xu

(10) Patent No.: US 9,340,259 B2
(45) **Date of Patent: *May 17, 2016**

(54) SEMI-SUBMERSIBLE FLOATING STRUCTURE FOR VORTEX-INDUCED MOTION PERFORMANCE

(71) Applicant: TECHNIP FRANCE, Courbevoie (FR)

(72) Inventor: Qi Xu, Katy, TX (US)

(73) Assignee: TECHNIP FRANCE, Courbevoie (FR)

( * ) Notice: Subject to any disclaimer, the term of this patent is extended or adjusted under 35 U.S.C. 154(b) by 21 days.

This patent is subject to a terminal disclaimer.

(21) Appl. No.: 14/309,528

(22) Filed: Jun. 19, 2014

(65) Prior Publication Data

US 2014/0299032 A1 Oct. 9, 2014

Related U.S. Application Data

(63) Continuation of application No. 13/025,462, filed on Feb. 11, 2011, now Pat. No. 8,757,081.

(60) Provisional application No. 61/411,676, filed on Nov. 9, 2010.

(51) Int. Cl.

| | |
|---|---|
| ***B63B 35/44*** | (2006.01) |
| ***B63B 21/00*** | (2006.01) |
| ***B63B 1/10*** | (2006.01) |

(52) U.S. Cl.

CPC ..... *B63B 21/00* (2013.01); *B63B 1/107* (2013.01); *B63B 35/44* (2013.01); *B63B 35/4413* (2013.01); *B63B 2021/003* (2013.01); *Y10T 137/0318* (2015.04)

(58) Field of Classification Search

CPC ..... B63B 21/00; B63B 1/107; B63B 21/003; B63B 35/44; B63B 35/4413; B63B 2001/044; B63B 35/34; B63B 39/00; B63B 35/38

USPC ..... 114/264, 265, 266, 267

See application file for complete search history.

(56) References Cited

U.S. PATENT DOCUMENTS

| | | | |
|---|---|---|---|
| 3,163,147 | A | 12/1964 | Collipp |
| 3,837,309 | A | 9/1974 | Biewer |

(Continued)

FOREIGN PATENT DOCUMENTS

| | | | |
|---|---|---|---|
| GB | 2159468 | A | 12/1985 |

OTHER PUBLICATIONS

Veritas, Det Norske. "Global performance analysis of deepwater floating structures." Høvik: Det Norske Veritas (2010).

(Continued)

*Primary Examiner* — Anthony Wiest

(74) *Attorney, Agent, or Firm* — Jackson Walker L.L.P.

(57) ABSTRACT

The disclosure provides a semi-submersible offshore platform with columns having an enlarged base on the bottom of each column with pontoons coupled between the columns. The enlarged column base can be at least as high as a height of the pontoon and on at least embodiment can be about 50% of the draft of the platform. The enlarged base can change a current flow shape around the base and columns for lower VIM. An outside corner of the base can be trimmed at an angle. Alternatively, the lower portions of the columns can be extended horizontally outward to form an effectively enlarged base having similar characteristics. In some embodiments, the pontoon volume can be reduced inversely proportional to the base enlargement to have comparable total buoyancy.

14 Claims, 7 Drawing Sheets

(56) References Cited

U.S. PATENT DOCUMENTS

| | | | |
|---|---|---|---|
| 3,982,401 | A | 9/1976 | Loggins |
| 4,169,424 | A | 10/1979 | Newby et al. |
| 4,585,373 | A | 4/1986 | Collipp |
| 4,626,137 | A | 12/1986 | Willemsz |
| 4,723,875 | A | 2/1988 | Sutton |
| 4,829,928 | A | 5/1989 | Bergman |
| 4,850,744 | A | 7/1989 | Petty et al. |
| 4,864,958 | A | 9/1989 | Belinsky |
| 4,906,139 | A | 3/1990 | Chiu et al. |
| 4,913,238 | A | 4/1990 | Danazcko et al. |
| 5,012,756 | A | 5/1991 | Kristensen |
| 5,439,321 | A | 8/1995 | Hunter |
| 5,558,467 | A | 9/1996 | Horton |
| 5,707,178 | A | 1/1998 | Srinivasan |
| 6,024,040 | A | 2/2000 | Thomas |
| 6,347,912 | B1 | 2/2002 | Thomas |
| 6,431,107 | B1 | 8/2002 | Byle |
| 6,447,208 | B1 | 9/2002 | Huang et al. |
| 6,478,511 | B1 | 11/2002 | Hudson et al. |
| 6,619,223 | B2 | 9/2003 | Beato |
| 6,652,192 | B1 | 11/2003 | Xu et al. |
| 6,718,901 | B1 | 4/2004 | Abbott et al. |
| 6,761,124 | B1 | 7/2004 | Srinivasan |
| 7,140,317 | B2 | 11/2006 | Wybro et al. |
| 7,462,000 | B2 | 12/2008 | Leverette et al. |
| 7,854,570 | B2 | 12/2010 | Heidari |
| 8,267,032 | B2 | 9/2012 | Zou |
| 8,608,408 | B1 | 12/2013 | Zou et al. |
| 2003/0147703 | A1 | 8/2003 | Cermelli et al. |
| 2005/0058513 | A1 | 3/2005 | Martensson et al. |
| 2005/0084336 | A1 | 4/2005 | Xu et al. |
| 2009/0114139 | A1 | 5/2009 | Zou |
| 2010/0092246 | A1 | 4/2010 | Tahar et al. |

OTHER PUBLICATIONS

Blazquez, L, International Search Report for International Patent Application No. PCT/US2011/059380; European Patent Office, dated Mar. 19, 2012.

Blazquez, L, Written Opinion for International Patent Application No. PCT/US2011/059380; European Patent Office, dated Mar. 19, 2012.

Blazquez, L, Written Opinion for International Patent Application No. PCT/US2011/059380; European Patent Office, dated Aug. 10, 2012.

SEMI-SUBMERSIBLE FLOATING STRUCTURE FOR VORTEX-INDUCED MOTION PERFORMANCE

CROSS REFERENCE TO RELATED APPLICATIONS

This application is a continuation of U.S. application Ser. No. 13/025,462, filed Feb. 11, 2011, which claims the benefit of U.S. Provisional Application No. 61/411,676, filed Nov. 9, 2010, which are incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates to a system and method for a deep draft semi-submersible floating structure for drilling and production. More particularly, the disclosure relates to a system and method for a semi-submersible floating structure to minimize vortex-induced motion.

2. Description of the Related Art

Most conventional semi-submersible offshore platforms for offshore drilling and production comprise a hull that has sufficient buoyancy to support a work platform above the water surface. The hull typically includes at least two horizontal pontoons that support at least three vertical columns which support the deck platform above the surface of the water. Semi-submersible platforms have become a favorable choice as a wet-tree floater support in harsh environments using steel catenary risers (SCR) extending to the seabed, mainly due its capability of quayside topside integration, cost-effectiveness, and acceptable motion when deployed offshore.

FIG. 1 is a perspective schematic diagram illustrating a conventional semi-submersible floating offshore platform design, showing only the underwater part of the hull. A conventional semi-submersible floating offshore platform 1 is deployed in a body of water in deep draft operational configuration and anchored to a seabed by mooring lines (not illustrated). The offshore platform 1 includes generally at least three, and often four, columns 2, spaced apart from each other and extending vertically from the platform base 3. The base is formed, in this example, with at least three, and often four, pontoons 4 coupled to the bottoms 2A of the columns 2. Each pontoon 4 extends between two bottoms of the columns. An exemplary draft of each column 2 is about 20-25 meters (m) for shallow draft platforms and about 35-45 m for deep draft platforms. The offshore platform 1 is generally moored to the seafloor (not shown) by catenary mooring lines 30 extending through fair leads 31 coupled at the lower ends of the columns.

A conventional semi-submersible, for example with a draft of 20 m, has a Vortex-Induced-Motion (VIM) that is acceptably small due to the small VIM excitation from the shallow draft. Vortex-Induced-Motion (VIM) or Vortex-Induced Vibrations (VIV) are motions induced on bodies facing an external flow by periodical irregularities of this flow. Typically, the term VIM is applied to a moored floating structure and the term VIV is applied to SCRs and other risers. Fluids present some viscosity, and fluid flow around a body, such as a cylinder in water, will be slowed down while in contact with its surface, forming a boundary layer. At some point, this boundary layer can separate from the body. Vortices are then formed, changing the pressure distribution along the surface. When the vortices are not formed symmetrically around the body with respect to its midplane, different lift forces develop on each side of the body, thus leading to motion transverse to the flow. VIM and VIV are important sources of fatigue damage of offshore oil exploration and production platforms, risers, and other structures. These structures experience both current flow and top-end vessel motions, which give rise to the flow-structure relative motion. The relative motion can cause VIM/VIV "lock-in". "Lock-in" occurs when the reduced velocity, $U_r$, is in a critical range depending on flow conditions and can be represented according to the formula below:

$$5<U_r=uT_n/D<7$$

$U_r$: Reduced velocity based on natural period of the moored floating structure u: Velocity of fluid currents (meters per second)

$T_n$: Natural period of the floating structure in calm water without current (seconds)

D: Diameter or width of column(meters)

Lock-in can occur when the vortex shedding frequency becomes close to a natural frequency of vibration of the structure. When lock-in occurs, large and damaging vibrations can result.

It is known that deep draft semi-submersibles suffer from VIM due to the increased excitation length of longer columns compared to shallow draft semi-submersibles with shorter columns.

Thus, there remains a need for improved performance with semi-submersible floating structures, particularly deep draft semi-submersible floating structures, regarding VIM.

BRIEF SUMMARY OF THE INVENTION

The disclosure provides a semi-submersible offshore platform with columns having an enlarged base on the bottom of each column with pontoons coupled between the columns. The enlarged base forms a column bottom portion with horizontal dimension extending horizontally outward from the column perimeter. The enlarged base can extend outward from the column at least 10% of a width of a column coupled to the at least one column base. In some embodiments, the enlarged base can extend in all directions from the column, herein "symmetrically", and in other embodiments the enlarged base can extend in less than all directions from the column, herein "asymmetrically". The enlarged base can be one single volume or multiple unconnected volumes. The enlarged base changes flow pattern around the base and column and breaks the coherence of vortex shedding. One example of such an enlarged base is a 45 degree, rotated square that is concentric with the column. The inboard corners of this rotated square base can be trimmed to match the pontoon width. The outward corners of this square base can also be trimmed for construction convenience, or other design considerations. Although the base height can vary relative to the pontoon height from lower to higher, the enlarged base is generally at least as high as the pontoon height and in some embodiments higher. When the enlarged base is higher than the pontoon, a top of the base is at an elevation between a top of the pontoon and a surface of water in which the platform floats. In at least one embodiment, the base height can be between 20 to 60% of the draft of the platform. In some embodiments, the pontoon volume can be reduced inversely proportional to the base enlargement to have comparable total buoyancy. The base itself can be further increased in size near the bottom of the base to accommodate other requirements, such as buoyancy at quayside.

It is believed that the enlarged base breaks the coherence of vortex shedding along the column length and therefore lowers the VIM. it is believed that the vortex shedding coherence along the column length is interrupted to some degree and the effective VIM excitation length of the column is reduced. It appears that the synchronization of the vortex shedding between columns is interrupted to some degree as well. The VIM is expected to be less than a similar semi submersible platform with constant cross-section columns with a deep draft. It is believed that the base and its structural interruptions in the column profile form interfering vortex flows that interrupt the overall vortex flow. This creation of interfering vortex flows is counterintuitive to typical design efforts in the industry that generally seek to limit vortex creation and seek to provide smooth flows around an offshore structure. In addition, the higher than conventional pontoons make VIM even smaller by providing more damping.

The disclosure provides a semi-submersible floating offshore structure with improved vortex-induced motion, comprising: a plurality of columns coupled to a deck and spaced apart from each other, the columns having a column height measured from a bottom of the columns to the deck; at least two column bases coupled to at least two columns, the column bases having a base height; at least two pontoons coupled to at least one of the column, column bases, or a combination thereof, the pontoons having a pontoon height; wherein the offshore structure has a draft height for floating in water, and at least one of the column bases has a base height of 20% to 60% of the draft height and has an extension width that is at least 10% of a width of a column coupled to the at least one column base.

The disclosure provides a method of improving vortex-induced motion of a semi-submersible floating offshore platform, the platform having a plurality of columns coupled to a deck and spaced apart from each other, the columns having a column height measured from a bottom of the columns to the deck, at least two column bases coupled to at least two columns, the column bases having a base height, and at least two pontoons coupled to at least one of the column, column bases, or a combination thereof, the pontoons having a pontoon height, wherein the offshore structure has a draft height for floating in water, and at least one of the column bases has a base height of 20% to 60% of the draft height and has an extension width that is at least 10% of a width of a column coupled to the at least one column base, comprising: allowing water to flow by the offshore structure; and breaking a coherence in vortex shedding around the offshore structure by creating interfering vortex currents around at least one of the columns and the column base coupled to the column as water flows by the column and column base.

DETAILED DESCRIPTION

Figure 1:
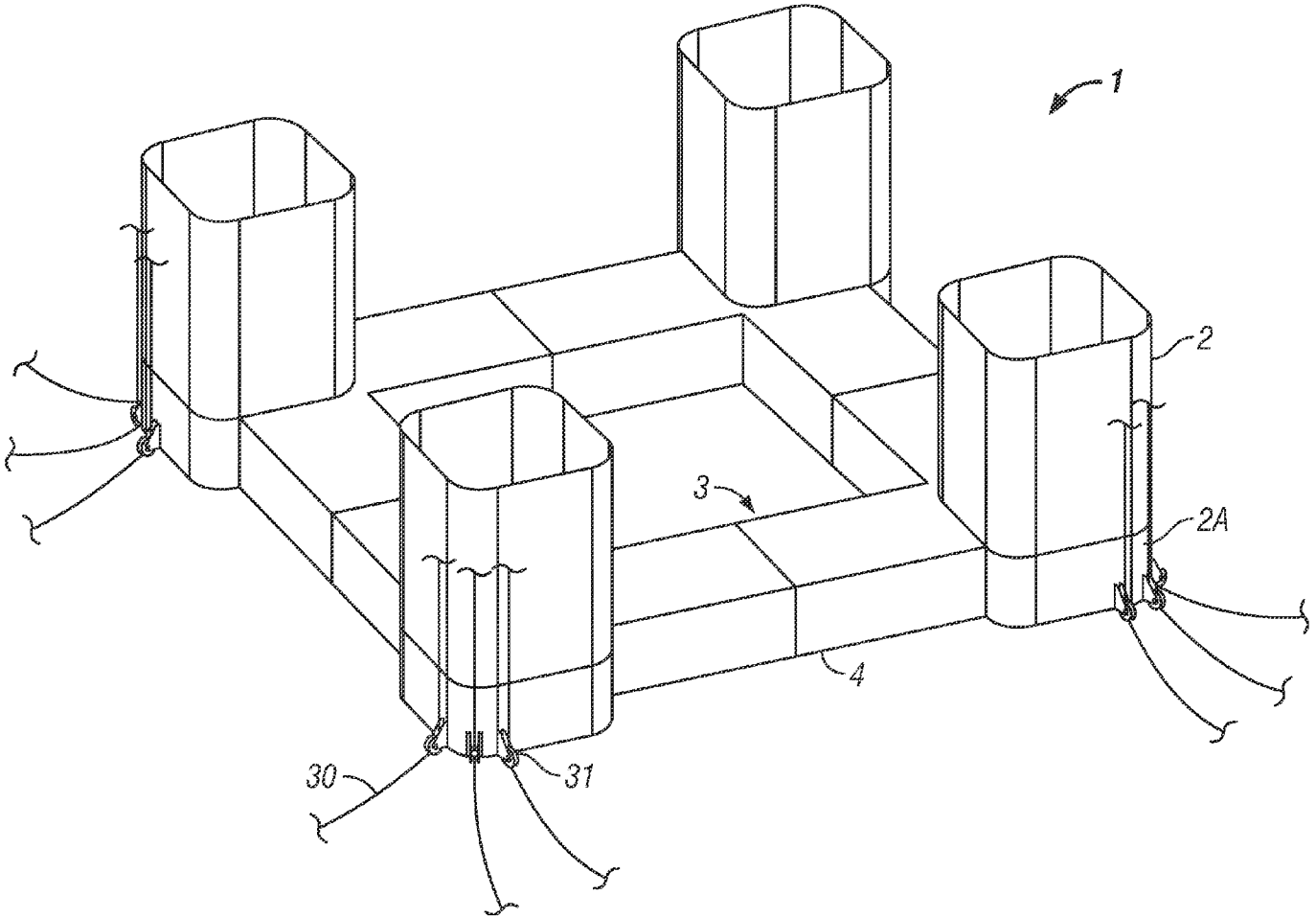
FIG. 1 Prior Art
FIG. 1 is a perspective schematic view illustrating a conventional semi-submersible offshore platform design, showing only the underwater part of the hull.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an alphabetic character after a number to reference a specific member of the numbered element to aid in describing the structures in relation to the Figures, but is not limiting in the claims unless specifically stated. When referring generally to such members, the number without the letter is used. Further, such designations do not limit the number of members that can be used for that function.

The disclosure provides a semi-submersible offshore platform with columns having an enlarged base on the bottom of each column with pontoons coupled between the columns. The enlarged column base can be at least as high as a height of the pontoon and on at least embodiment can be about 50% of the draft of the platform. The enlarged base can change a current flow shape around the base and columns for lower VIM. An outside corner of the base can be trimmed at an angle. Alternatively, the lower portions of the columns can be extended horizontally outward to form an effectively enlarged base having similar characteristics. In some embodiments, the pontoon volume can be reduced inversely proportional to the base enlargement to have comparable total buoyancy.

Figure 2A:
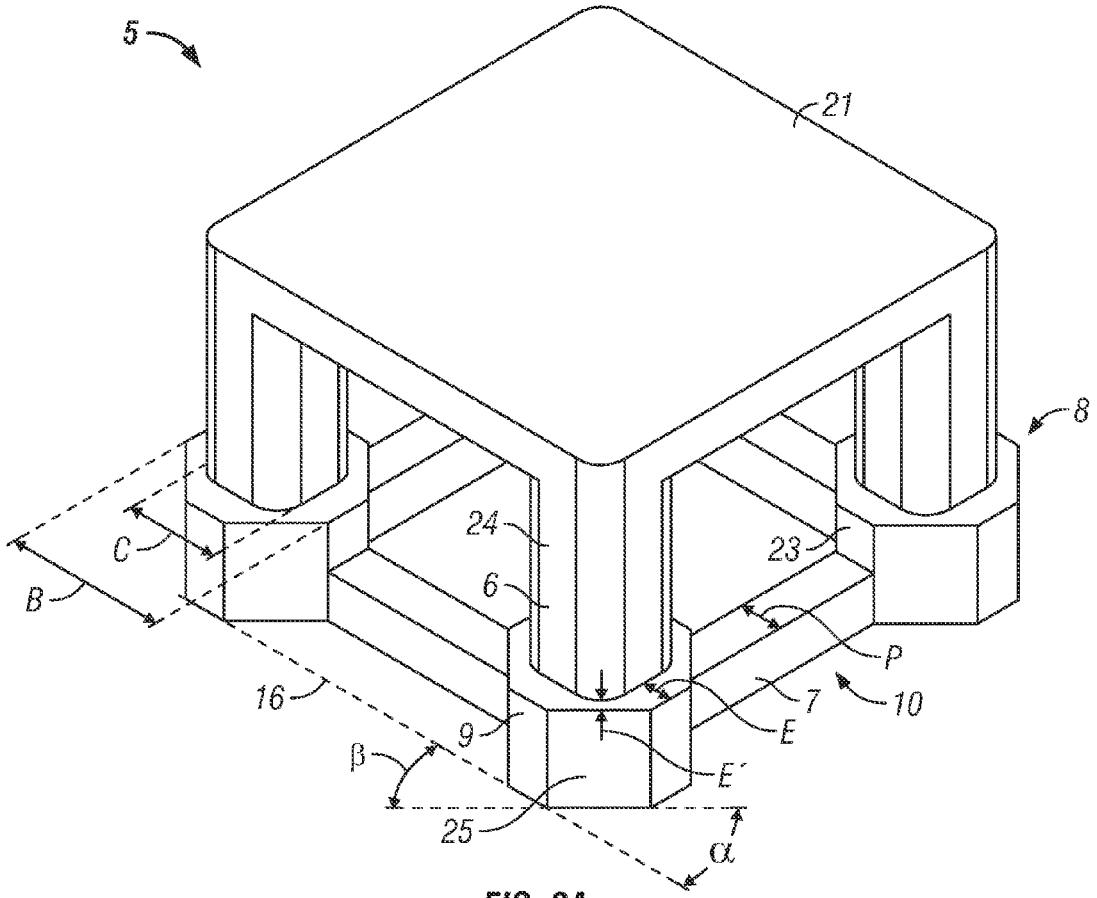
FIG. 2A is a perspective schematic view illustrating an exemplary semi-submersible floating offshore platform according to the teachings herein with enlarged column bases.
Figure 2B:
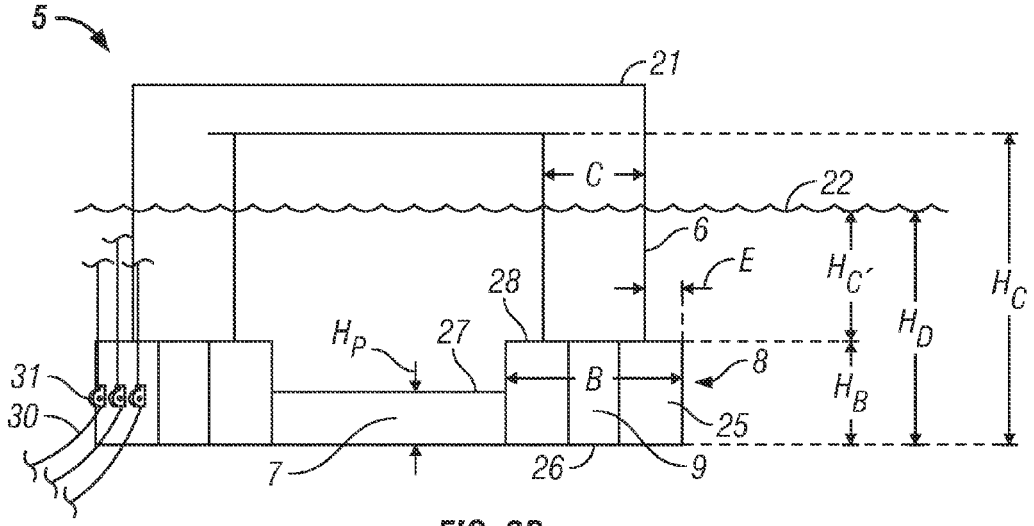
FIG. 2B is a top schematic view of the exemplary semi-submersible floating offshore platform of FIG. 2A.
Figure 2C:
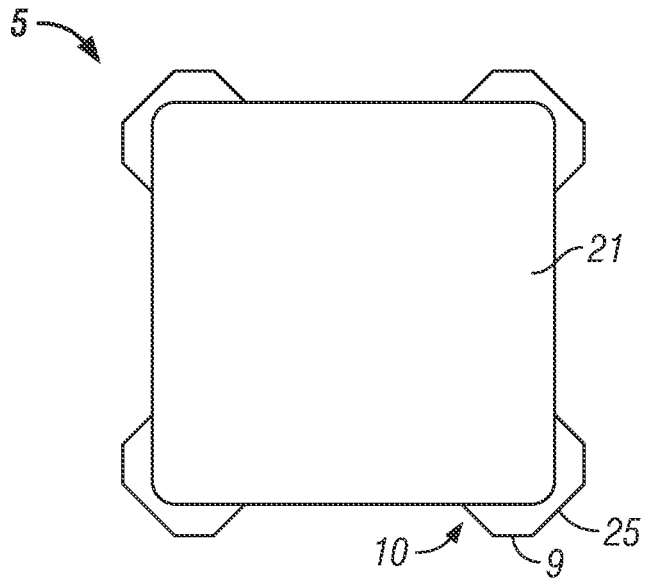
FIG. 2C is a side schematic view of the exemplary semi-submersible floating offshore platform of FIG. 2A.

FIG. 2A is a perspective schematic diagram illustrating an exemplary semi-submersible floating offshore platform according to the teachings herein with enlarged column bases. FIG. 2B is a top schematic view of the exemplary semi-submersible floating offshore platform of FIG. 2A. FIG. 2C is a side schematic view of the exemplary semi-submersible floating offshore platform of FIG. 2A. The figures will be described in conjunction with each other. The exemplary offshore platform 5 can comprise four columns 6 spaced apart from each other and extending vertically to a deck 21, although fewer or more columns can be used. The column 6 is coupled to a column base 8. The column base 8 is enlarged relative to the column 6 generally around the column and thus is termed "symmetrical" herein, although the amount of enlargement or extension around the column may vary. The column base 8 has a base cross-sectional dimension "B" that is greater than a corresponding column cross-sectional dimension "C" of the column 6, where the dimensions are measured from the outsides of the relevant structure. At least one of the column bases extends beyond the column that is coupled to such base by an amount, termed herein as an extension width "E". The amount of the extension width E can be at least 10% of a width of a column coupled to the at least one column base, at least 20% greater, and advantageously at least 30% greater beyond the column. The term "width" is used broadly herein and is intended to mean an average width across the column or base from a side of the column through the middle of the column to an opposite outside point, or across a rounded column, if circular or elliptical. For example, a rectangular column was a width measured perpendicular to the sides. A hexagonal or octagonal column has a width measured perpendicular from one face to an opposite face passing through a center of the octagon. A circular column has a width across the diameter. A rectangular column has a width that is averaged from a dimension perpendicular across the short and long sides. An elliptical column has a width that is averaged from the minor and major axis through the center of the ellipsis. For off-shaped columns not having directly aligned opposite sides, such a triangles and pentagons, the width could be measured perpendicular to a side through a center of the column to the opposite corner. Thus, in at least one embodiment, the minimum extension of the base beyond the column could be determined by measuring a width of the column, and multiplying that dimension by 10% to determine the amount of the base extension beyond the column.

The column base can have a base height "$H_B$", and the column can have a column height $H_C$ from a column bottom 26 to the deck 21. The column base 8 can effectively replace a portion of the length of a conventional column 6 that is without a base, making the column length effectively $H_C'$, and thus shortening the effective column length relative to water flow past the column. The column base 8 can surround a portion of the column 6 or be coupled to a bottom of the column. Generally, mooring lines 31 will be slidably coupled through the fair leads 31 to the column base 8.

The semi-submersible floating offshore platform 5 can be deployed in a body of water in deep draft operational configuration. Generally, a draft "$H_D$" is measured from the bottom of the structure to a mean water surface 22. In at least some embodiments, the base height $H_B$ can be a substantial percentage of the draft $H_D$ of the semi-submersible floating offshore platform, such as about 20% to 60% and any incremental percentage therebetween (such as 21% to 59%, 30% to 50%, 20.1% to 59.9%, and so forth), more narrowly about 40% to 60% and any incremental percentage therebetween, and advantageously about 50% of the draft.

The column bases 8 are coupled together by pontoons 7 to form a platform base 10. Generally, any given column, the column base coupled to the column, or a combination thereof will be coupled to at least two pontoons to form a closed assembly of pontoons and columns/bases. The pontoon 7 has a pontoon width "P" and a pontoon height "$H_P$". In the exemplary embodiment shown in FIG. 2A, the pontoon is relatively a constant width. Generally, the base height $H_B$ is at least as high as the pontoon height $H_P$. In some embodiments, the base height $H_B$ is greater than the pontoon height $H_P$, so that a top 28 of the base 8 is disposed between a top 27 of the pontoon and the water surface 22.

The enlarged column base helps to break the coherence in vortex shedding along the overall column length. It is believed that breaking the coherence is caused by the additional structure that creates interfering vortex currents around the column and column base as water flows by the columns and column bases. The interfering localized vortex currents oppose the overall vortex currents for the floating offshore structure to create localized disruptions in the vortex currents. These localized disruptions are usually to be avoided in conventional designs of offshore vessels. However, the inventor has realized that the intentional creation of such localized vortex currents can be used productively to disrupt the overall vortex current on the floating offshore structure and lower the overall VIM.

In at least one embodiment, a side 25 of the column base 8 can be oriented at an angle "α" to a side 24 of the column 6, so that the column base is effectively "rotated" relative to the column. The angle "α", relative to a line 16 drawn between the columns on a given side of the platform 5, can be between 10 to 80 degrees and any angle therebetween, advantageously between 30 to 60 degrees, and more advantageously 45 degrees. It is to be understood that the angular measurement in degrees is not meant to be a precise measurement, but is meant to describe an angle that is within the customary engineering and construction parameters for such large structures. An inboard corner 23 can be constructed ("trimmed") to match a width of the mating pontoon 7. Optionally, an outward corner 9 can also be trimmed to suit construction needs. The amount of an angle "β" of the trimmed corners can similar to the amount of the angle "α" of the column base. While one each of the corners 9, 23 is described, it is understood that other corners of the base can be likewise formed.

Further, when the base is rotated, the resulting amount of the extension width E' of the base beyond the column at the rotated side can be adjusted to meet the pre-established criteria of percentage extension of the base beyond the column.

Compared to a conventional semi-submersible floating offshore platform, a percentage of total volume of the platform base 3 can be shifted to the enlarged column bases 8, so that a percentage of the total volume in the pontoons 7 is decreased. This shift effectively reduces heave load on the offshore platform 5, because wave forces acting on the widely separated column bases 8 for each column 6 will not reach maximum at the same time, due to the wave phasing. In a non-limiting example, the pontoon 7 can be about 10 meters (m) wide and 12 m high. The exemplary length of the pontoon can be about 48 m. The exemplary height $H_B$ of the base 8 can be about 20 m high, and the exemplary draft of the column 6 can be about 41 m high from the column bottom 26 to the water surface 22. The column 6 can extend another 20 m high above the water surface 22 to the deck 21, so that the total height Hc of the column 6 from the bottom 26 to deck 21 is about 61 m and the effective height $H_C'$ of the column is 41 m, that is, the difference between the column height and the base height. The column base 8 on the column bottom 26 effectively reduces the column length of the column 6 before encountering the column base 8, and helps to break the coherence in vortex shedding between the column and column base.

Figure 2D:
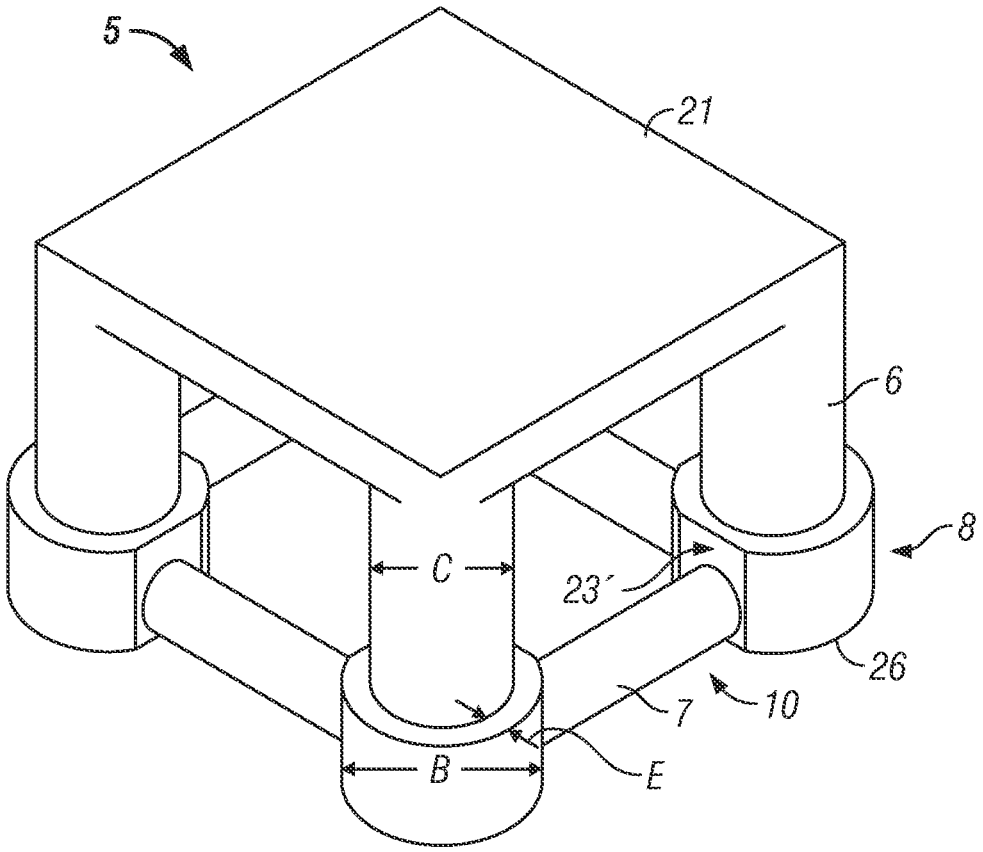
FIG. 2D is a perspective schematic view illustrating a variation of the exemplary semi-submersible floating offshore platform of FIG. 2B.

FIG. 2D is a perspective schematic view illustrating a variation of the exemplary semi-submersible floating offshore platform of FIG. 2B. The platform 5 includes a plurality of columns 6 that are coupled with a column base 8 with pontoons 7 coupled therebetween. The column bases 8 and pontoons 7 form the platform base 10. The columns 6 and column bases 8 are generally circular in cross-sectional shape. The column base 8 has a cross-sectional dimension B that is greater than the cross-sectional dimension C of the column 6 to leave an extension width E beyond the base, as described above. If suitable, an inside surface 23' of the column 6 can be trimmed for coupling to the pontoon 7.

Figure 3A:
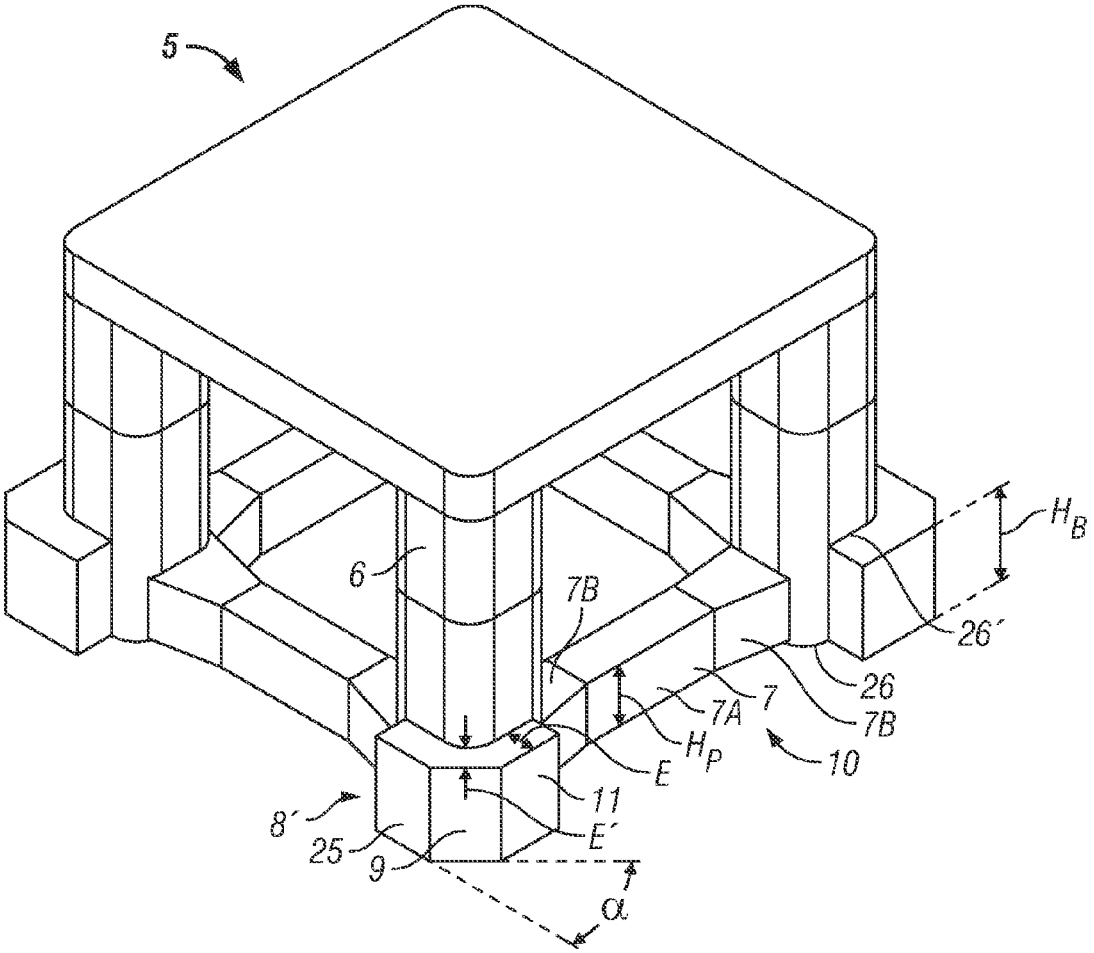
FIG. 3A is a perspective schematic diagram illustrating an alternative exemplary semi-submersible floating offshore platform with enlarged bases according to the teachings herein.
Figure 3B:
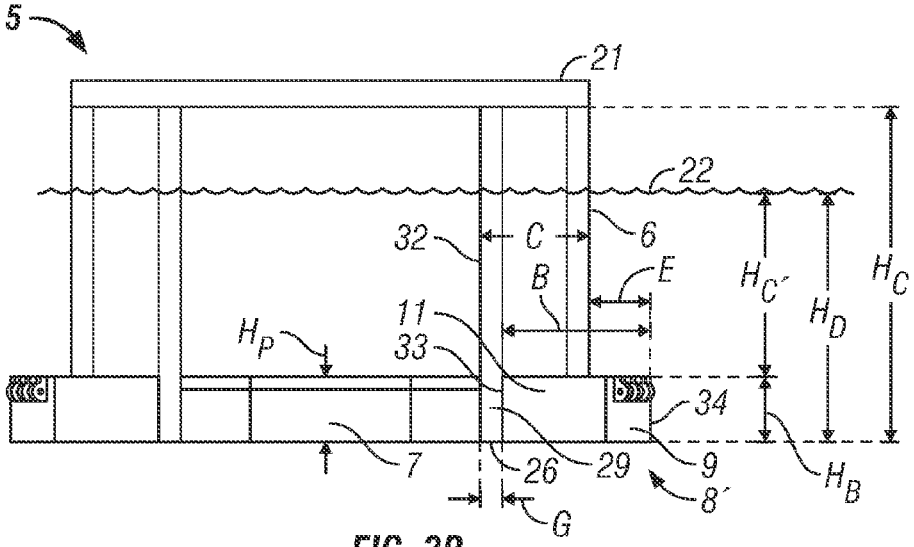
FIG. 3B is a side schematic view of an alternative exemplary semi-submersible floating offshore platform, similar to the embodiment shown in FIG. 3A with the primary difference being the height of the pontoon relative to the base.

FIG. 3A is a perspective schematic diagram illustrating an alternative exemplary semi-submersible floating offshore platform with enlarged bases according to the teachings herein. FIG. 3B is a side schematic view of an alternative exemplary semi-submersible floating offshore platform, similar to the embodiment shown in FIG. 3A with the primary difference being the height of the pontoon relative to the base. The figures will be described in conjunction with other.

The semi-submersible floating offshore platform 5 can include an effective column base 8' in conjunction with the column 6. The column base 8' can be formed from a column horizontal extension 11 that is coupled to the lower portion of the column 6 on one or more outward sides of the column 6 and not around the entire column, and thus is termed "asymmetrical" herein, where the amount of asymmetry can vary. The horizontal extension 11 effectively enlarges the column 6 in that zone and creates an effective column base 8' that includes the column horizontal extension that functions as a column base 8, referenced in FIGS. 2A-2D. The effective column base 8' has a cross-sectional dimension B that is greater than the cross-sectional dimension C of the column 6 resulting in an extension width E of the column base 8' relative to the column 6. The column 6 is thus effectively shortened relative to water flow around the outward portions of the column before encountering the effective column base 8'. The column horizontal extension 11 establishes an effective outward bottom 26' of the column at a top of the column horizontal extension on the outside portion of the column 6 and thus effectively shortens the column compared to a column without the column base 8'. Optionally, a corner 9 can be sharp or angled, as described herein. The columns 6 with the effective column bases 8' are linked by the pontoons 7 to form the platform base 10, also as described above.

Further, the column extension 11 can be offset from the column to form a gap 29 between a side 32 on the column 6 and a side 33 on the effective base 8', which sides in the embodiment shown in FIG. 3B are distal from an outward side 34 of the column horizontal extension 11. The gap 29 introduces structure that can also create vortex currents to interrupt the overall vortex current around the floating offshore platform and otherwise change a current flow shape around the base and columns for lower VIM.

Among other aspects, such a design can be used to retrofit existing conventional platforms, such as shown in FIG. 1, to benefit according to the teachings herein.

Similar to the embodiment in FIGS. 2A-2C, a percentage of the pontoon volume is shifted to the effective column base of each column. This shift effectively reduces the heave load on the platform due to the wave phasing. In this particular non-limiting example, the pontoon width can vary and can be 10 m wide at mid-span 7A, 16 m wide at the ends 7B, and 12 m high. The length of this pontoon can be 48 m. The column horizontal extension 11 can be 20 m in height $H_B$, and 8 m in extension width E beyond the column, measured horizontally from an outside of the column to an outside of the extension. The column can be 61 m high $H_C$ from the bottom 26, and 41 m for the effective height $H_C'$. The operating draft $H_D$ can be 41 m, so the column 6 can extend about 20 m above the water surface 22 in a normal draft position. As referenced above, the height $H_B$ of the column horizontal extension 11 can be a significant portion of the draft height $H_D$, such as about 20% to 60% and any incremental percentage therebetween, about 40% to 60%, and advantageously about 50% of the draft height. As an effective column base 8', the column horizontal extension 11 helps to break the coherence in vortex shedding along the column length.

Figure 4C:
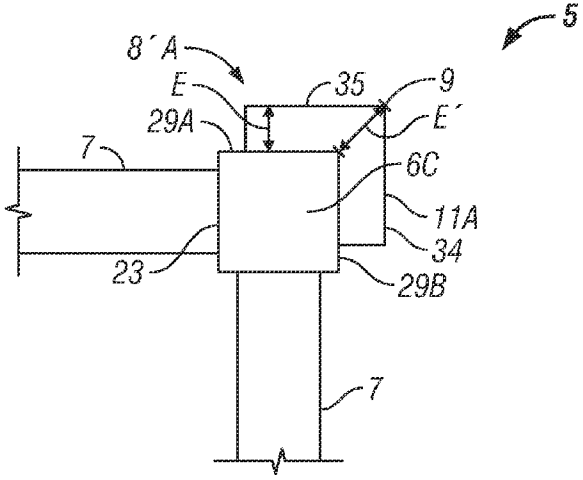
FIG. 4C is a top schematic view of another exemplary column and column base.
Figure 4D:
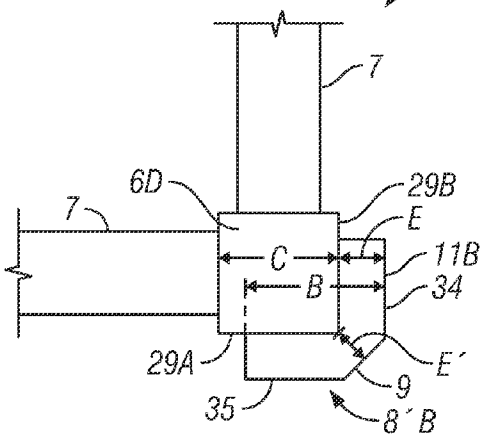
FIG. 4D is a top schematic view of another exemplary column and column base.
Figure 4A:
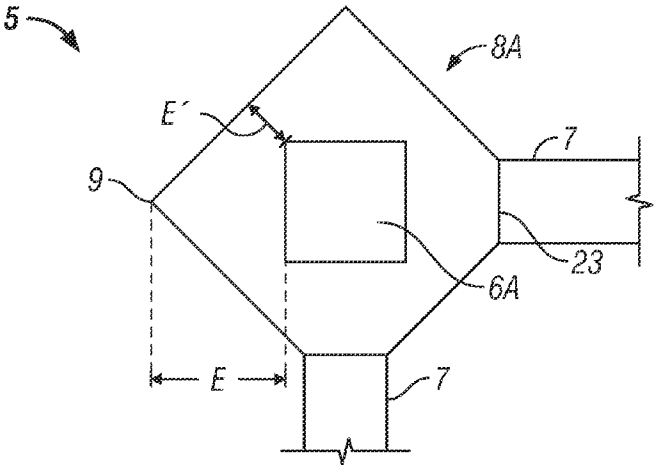
FIG. 4A is a top schematic view of the exemplary column and column base.

FIG. 4A is a top schematic view of the exemplary column and column base. The column 6 can be disposed on or in a symmetrical column base 8A. One or more outward corners 9 can be sharp and one or more inward corners 23 can be trimmed to match a width of the mating pontoon 7. The base 8A can symmetrically extend beyond the column 6A having an extension width E. The extension width E' can be sufficiently large to meet pre-established criteria on the percentage extension of the base beyond the column described above.

Figure 4B:
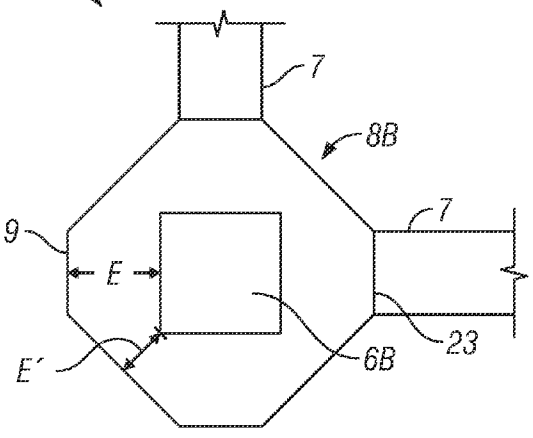
FIG. 4B is a top schematic view of another exemplary column and column base.

FIG. 4B is a top schematic view of another exemplary column and column base. The column 6B can be disposed on or in a symmetrical column base 8B having an extension width E. An outward corner 9 can be trimmed at an angle, and an inward corner 23 can be trimmed to match a width of the mating pontoon 7. The extension width E' can be sufficiently large to meet pre-established criteria on the percentage extension of the base beyond the column described above.

FIG. 4C is a top schematic view of another exemplary column and column base. An effective column base 8'A is coupled to the column 6C having an extension width E beyond the column . The effective column base 8'A is asymmetrically disposed around the column 6C. The effective column base 8'A is formed by a column horizontal extension 11A that can be coupled to the column 6C on the two outward sides of the column 6C. The column horizontal extension 11A can be coupled to the column 6C in such a manner as to leave a gap 29A formed distally from an outward surface 34 of the extension 11A and a gap 29B formed distally from an outward surface 35 of the extension. An outward corner 9 of the extension can be sharp. The extension width E' can be sufficiently large to meet pre-established criteria on the percentage extension of the base beyond the column described above.

FIG. 4D is a top schematic view of another exemplary column and column base. An effective column base 8'B is coupled to the column 6D having an extension width E. The effective column base 8'C is asymmetrically disposed around the column 6D as shown in the top view. The effective column base 8'A is formed by a column horizontal extension 11B that can be coupled to the column 6D on the two outward sides of the column 6. The column horizontal extension 11A can be coupled to the column 6C is such a manner as to leave a gap 29A formed distally from an outward surface 34 of the extension and a gap 29B formed distally from an outward surface 35 of the extension. An outward corner 9 can be trimmed at an angle.

Figure 4E:
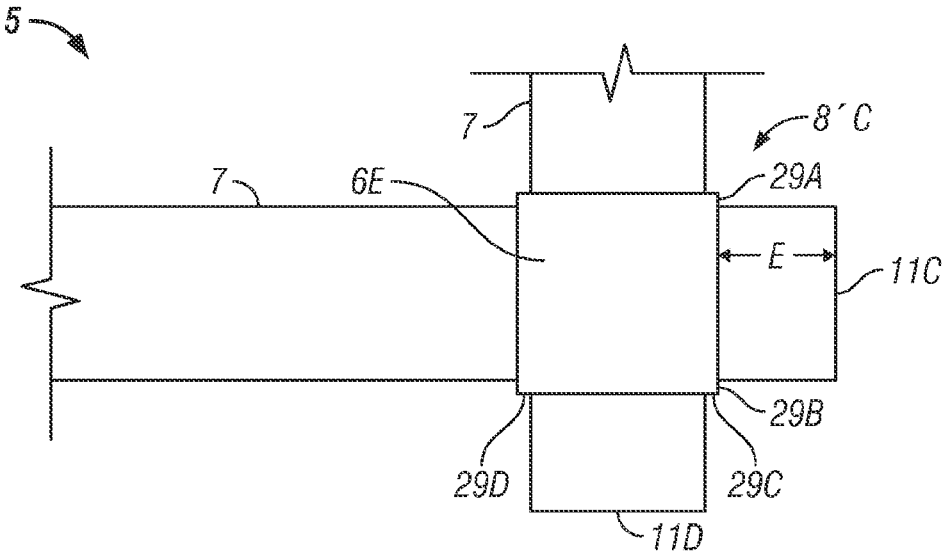
FIG. 4E is a top schematic view of another exemplary column and column base.

FIG. 4E is a top schematic view of another exemplary column and column base. An effective column base 8'C is coupled to the column 6E having an extension width E. The effective column base 8'C is asymmetrically disposed around the column 6E as shown in the top view. A column horizontal extension 11C can be coupled to an outward side of the column 6E. The column horizontal extension 11C can be coupled to the column 6E is such a manner as to leave a gap 29A and a gap 29B on the sides of the extension 11C. The gaps expose structure that helps create vortex currents to break the vortex coherence around the offshore structure and reduce the VIM. Another column horizontal extension 11D can be coupled to another outward side of the column 6E. The column horizontal extension 11D can be coupled to the column 6E is such a manner as to leave a gap 29C and a gap 29D on the sides of the extension 11D.

The exemplary column bases and effective column bases can be combined in various manners. For example, all columns on a particular offshore floating platform can have the same or similar designed symmetrical or asymmetrical bases. Alternatively, the columns on a particular offshore floating platform can have dissimilar symmetrical or asymmetrical bases, where a column could have a different base than another column.

Figure 5:
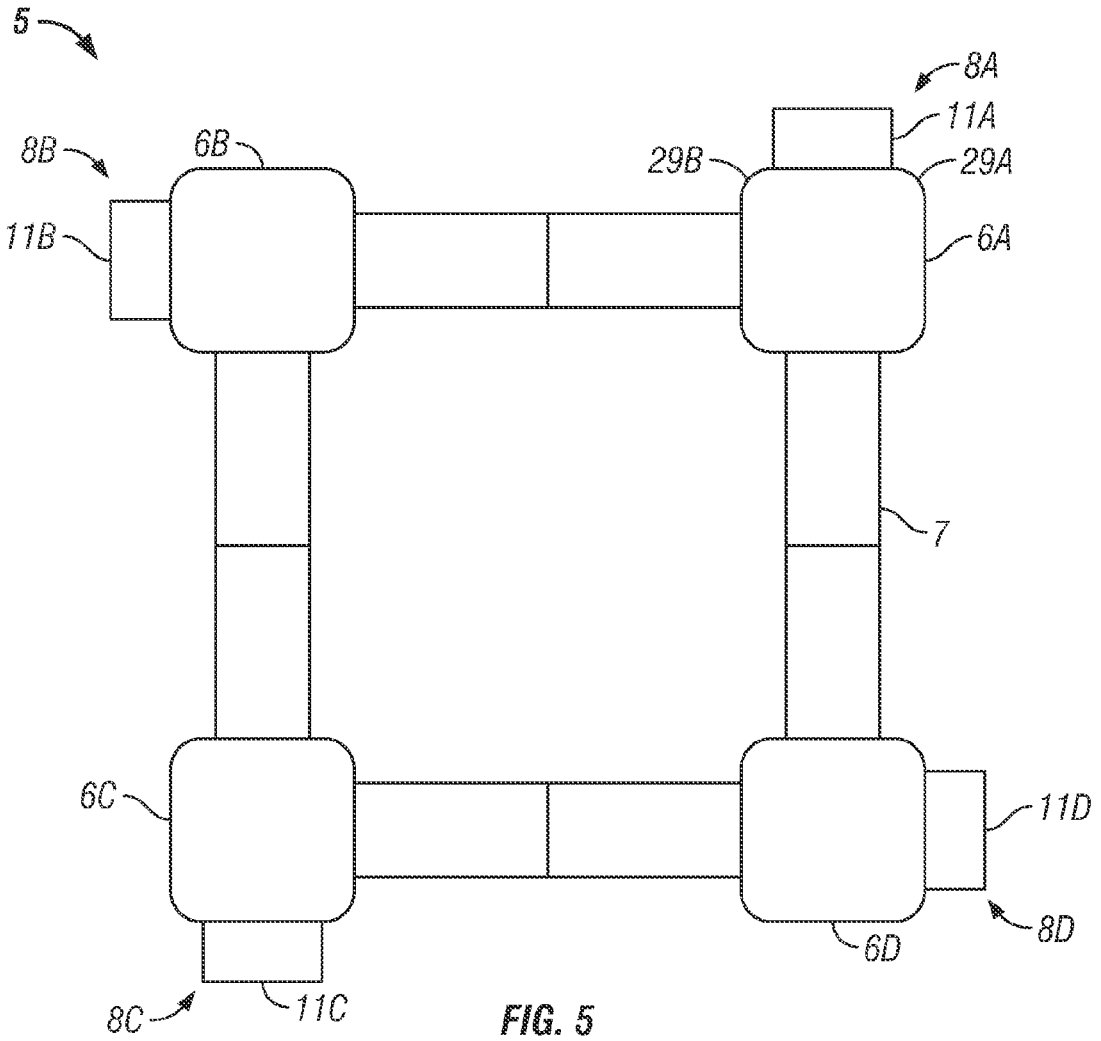
FIG. 5 is a top schematic view of another exemplary semi-submersible floating offshore platform

FIG. 5 is a top schematic view of another exemplary semi-submersible floating offshore platform. The columns 6 can be coupled with one or more pontoons 7 disposed therebetween. An effective column base 8A having a column horizontal extension 11A can be disposed horizontally outward in a first direction from the column 6A. As an example, the column horizontal extension 11A can be coupled to the column 6A is such a manner as to leave a gap 29A and a gap 29B on the sides of the extension 11A. Another column base 8B having a column horizontal extension 11B can be disposed horizontally outward in a second direction from its respective column 6B that is different from the first direction. Another column base 8C having a column horizontal extension 11C can be disposed horizontally outward in a third direction from its respective column 6C that is different from the first and second directions. Another column base 8D having a column horizontal extension 11D can be disposed horizontally outward in a fourth direction from its respective column 6D that is different from the first, second, and third directions. Other combinations are possible including disposing the horizontal extensions on two columns on sides being disposed in the same direction from their respective columns.

EXAMPLE

Figure 6:
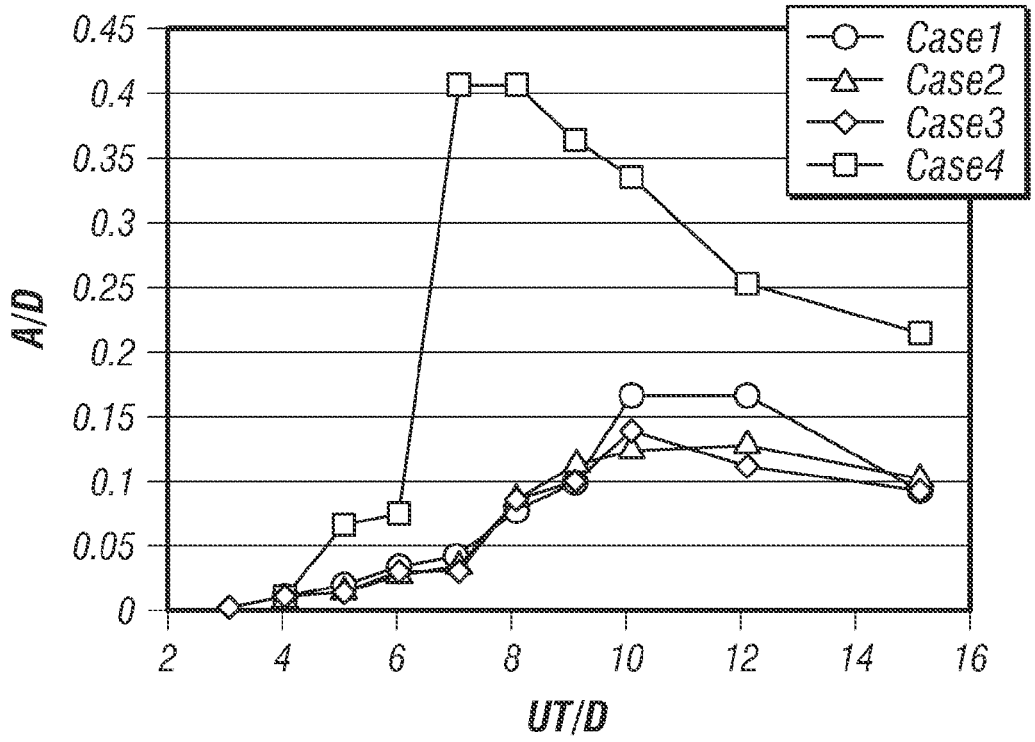
FIG. 6 is a Vortex-Induced-Motion (VIM) graph of various tested configurations for contrasting the behavior between a conventional semi-submersible floating offshore platform design and various embodiments of the new design described herein.

FIG. 6 is a Vortex-Induced-Motion (VIM) graph of various tested configurations for contrasting the behavior and the resulting VIM around the offshore platform 5 between a conventional semi-submersible floating offshore platform design and various embodiments of the new design described herein. FIGS. 6 illustrates a representative chart from such VIM test results.

The tests were performed in a still water towing tank with the model towed by a carriage to simulate a uniform and constant current. One spring was attached to each corner of the model, the other end of the spring was fixed to the carriage. The six (6) degrees of freedom motions of the model were measured by an optical tracking system, and the tension of each spring was measured by an inline load cell. The speed of the carriage was adjustable and the entire velocity range of interest was covered by multiple tows.

Cases 1, 2, and 3 are all of type as exemplified in FIG. 3A. Case 1 includes a column having an asymmetric base of a column horizontal extension that extended outwardly from the column by about 8 m and a base height $H_B$ that is 6 m higher than a pontoon height $H_P$ that is coupled to the columns, bases, or a combination thereof. Case 2 includes a column having an asymmetric base of a column horizontal extension that extended outwardly from the column by about 9 m and a base height $H_B$ that is 3 m higher than a pontoon height $H_P$ that is coupled to the columns, bases, or a combination thereof. Case 3 includes a column includes a column having an asymmetric base of a column horizontal extension that extended outwardly from the column by about 10.5 m and a base height $H_B$ that substantially equal to a pontoon height $H_P$ that is coupled to the columns, bases, or a combination thereof. Case 4 includes a conventional column that is coupled to a pontoon without the column base.

In general, the magnitude of VIM factor on the platform in the Y-axis is graphed based on the water current factor in the X-axis at a heading of 45 degrees. The graph charts the response of (1) the velocity of water currents multiplied by the natural period of the structure in calm water divided by the width of the column (or column base) on the X-axis compared to (2) the platform structure movement amplitude divided by the column width (or column base) on the Y-axis. As shown in FIG. 6, a conventional platform (Case 4) has the worst VIM in the test results. Cases 1-3 have significantly lower VIM.

Other and further embodiments utilizing one or more aspects of the invention described above can be devised without departing from the spirit of the invention. For example, the various numbers of columns and bases can be used, and various lengths of columns and bases can be used with various shapes. Other variations in the system are possible.

Further, the various methods and embodiments described herein can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Apparent modifications and alterations to the described embodiments are available to those of ordinary skill in the art given the disclosure contained herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A semi-submersible floating offshore structure with improved vortex-induced motion ("VIM"), comprising:

a plurality of columns coupled to a deck and spaced apart from each other, the columns having a column height measured from a bottom of the columns to the deck, the columns being subject to lock-in based on factors of velocity of fluid currents, natural period of the floating structure in calm water without current, and diameter or width of column;

at least two column bases coupled to at least two columns, the column bases having a base height and at least one of the column bases being configured asymmetrically around the respective column; and at least two pontoons coupled to at least one of the column bases, the columns, or a combination thereof, the pontoons having a pontoon height that is less than the base height of at least one of the column bases;

wherein the semi-submersible floating offshore structure is coupled to a plurality of mooring lines and has a draft height for floating in water, and at least one of the column bases has a base height relative to the draft height so that the column base is underwater when the semi-submersible offshore structure is floating in the water and has a width so that the column base extends beyond a column coupled to the at least one column base, wherein at least one column base is configured to break a coherence in vortex shedding around the offshore structure by creating interfering vortex currents around at least one of the columns to reduce VIM caused by the lock-in.

2. The structure of claim 1, wherein the base height is 40% to 60% of the draft height.

3. The structure of claim 1, wherein at least one of the column bases extend asymmetrically outward from at least one of the columns coupled to the bases.

4. The structure of claim 1, wherein at least one of the column bases is offset from the column coupled to the column base to form a gap between a side on the column and a side on the base that are distal from an outward side of the base.

5. The structure of claim 1, wherein at least one of the column bases comprises a column horizontal extension.

6. The structure of claim 5, wherein the column horizontal extension has a corner extending outward from the platform, the corner being formed at an angle between 10 and 80 degrees relative to a line drawn between two of the columns along a side of the platform.

7. The structure of claim 1, wherein a side of at least one of the column bases is oriented at an angle to at least one side of the columns.

8. The structure of claim 7, wherein the angle is 10 to 80 degrees relative to a line drawn between two of the columns along a side of the platform.

9. The structure of claim 1, wherein the floating offshore structure comprises at least three columns, and at least three column bases coupled to the columns.

10. The structure of claim 1, wherein lock-in is according to the formula:

$5<Ur=uTn/D<7$, where:

Ur : Reduced velocity based on natural period of the moored floating structure u : Velocity of fluid currents (meters per second)

Tn : Natural period of the floating structure in calm water without current (seconds)

D : Diameter or width of column(meters).

11. A method of improving vortex-induced motion of a semi-submersible floating offshore platform, the platform having a plurality of columns coupled to a deck and spaced apart from each other, the columns having a column height measured from a bottom of the columns to the deck, the columns being subject to lock-in based on factors of velocity of fluid currents, natural period of the floating structure in calm water without current, and diameter or width of column, at least two column bases coupled to at least two columns, the column bases having a base height and at least one of the column bases being configured asymmetrically around the respective column, and at least two pontoons coupled to at least one of the column bases, the columns, or a combination thereof, the pontoons having a pontoon height that is less than the base height of at least one of the column bases, wherein the semi-submersible floating offshore structure is coupled to a plurality of mooring lines and has a draft height for floating in water, and at least one of the column bases has a base height relative to the draft height so that the column base is underwater when the semi-submersible offshore structure is floating in the water and has a width so that the column base extends beyond a column coupled to the at least one column base, comprising:

allowing water to flow by the offshore structure; and breaking a coherence in vortex shedding around the offshore structure by creating interfering vortex currents around at least one of the columns and the column base coupled to the column as water flows by the column and column base to reduce VIM caused by the lock-in.

12. The method of claim 11, further comprising breaking a synchronization of vortex shedding between columns.

13. The method of claim 11, wherein at least one of the column bases is coupled to at least one of the columns to form a gap between a side on the column and a side on the base that are distal from an outward side of the base, and further comprising: creating vortex currents around the gap for breaking the coherence in vortex shedding.

14. The method of claim 11, wherein lock-in is according to the formula:

$5<Ur=uTn/D<7$, where:

Ur : Reduced velocity based on natural period of the moored floating structure u : Velocity of fluid currents (meters per second)

Tn : Natural period of the floating structure in calm water without current (seconds)

D : Diameter or width of column(meters).

* * * * *